United States Patent [19]

Beyl, Jr.

[11] 4,293,851

[45] Oct. 6, 1981

[54] SOUND ACTUATOR

[76] Inventor: Earl Beyl, Jr., 4803 S. 5th St., Louisville, Ky. 40202

[21] Appl. No.: 88,779

[22] Filed: Oct. 29, 1979

[51] Int. Cl.[3] ..... G08B 3/00

[52] U.S. Cl. ..... 340/384 E; 340/384 R

[58] Field of Search ..... 340/384 E, 384 R, 674; 46/232, 231

[56] References Cited

U.S. PATENT DOCUMENTS

| | | | |
|---|---|---|---|
| 3,284,796 | 11/1966 | Borsattino | 340/384 E |
| 3,341,842 | 9/1967 | Bregurt | 46/232 X |
| 3,375,376 | 3/1968 | Kermodie | 340/384 E |
| 4,065,767 | 12/1977 | Neuhof | 340/384 E |
| 4,138,709 | 2/1979 | Colwill | 340/674 |

*Primary Examiner*—Harold I. Pitts

*Attorney, Agent, or Firm*—Edward M. Steutermann

[57] ABSTRACT

A horn and actuator circuit particularly useful in connection with selective actuation of a horn located onboard a model railroad train as the train transverses a selected section of track wherein the horn is selectively actuated and deactuated by a magnetic field of selected polarity located at the track and where the horn assembly includes a magnetic field detector to detect the magnetic polarity most recently received to actuate and deactuate the horn means. The horn means can include at least one oscillator adapted to generate a square wave pulse of selected frequency and can include one or more additional horns to generate square wave pulses of a second frequency as well as arrangements where the output frequency and intensity of an oscillator is modified to provide a sound of variable frequencies and intensity simulating a steam whistle.

11 Claims, 7 Drawing Figures

SOUND ACTUATOR

BACKGROUND OF THE INVENTION

The present invention relates to a device which is useful for example, in connection with model railroading and more particularly a horn arrangement which is selectively actuated at locations along a track traversed by the model railroad unit.

In model railroading, where simulation of reality is of the utmost importance, it has been found desirable to provide horn means either for a diesel model railroad or steam model where the horn can be located onboard the train to be actuated at selected locations to give the simulation of reality in that the sound emanates from the moving model train.

Such devices have been provided in prior H.O. gauge model railroads where three rails are provided so that accessory circuit is provided between ground and one rail while the power supply is provided between ground and the second rail.

However, in the more popular "O" gauge and "N" gauge model railroad devices where only two rails are provided to give a semblance of reality to a model layout, provision of an onboard horn is considerably more difficult in as much as there is no alternate circuit for selectively supplying electrical energy to accessory equipment.

Some arrangements are known where a carrier frequency is imposed on the track at a high frequency to initiate operation of onboard device; however, such arrangements are prohibitively expensive in most cases, complicated to fabricate, and maintain and still require the operator to manually actuate the horn. While such arrangements may be satisfactory in some applications where a complex model layout is involved with several model railroad trains running at the same time manual operation becomes cumbersome and in some cases unrealistic.

Specifically, it has been observed in most model railroad layouts the actuation of the horn occurs regularly at specific locations, for example, crossings. In prior art devices realistic operation of the layout would require that the operator manually actuate the horn in a realistic pattern each time the train approaches and passes the crossing. When several trains are in operation, the operator simply does not have the time to monitor the position of each train relative to each crossing so realism suffers.

No prior art device is known to permit the automatic actuation and deactuation of a horn carried onboard a model railroad at specific locations on the track on a model layout.

SUMMARY OF THE INVENTION

The present invention provides a new and novel arrangement which is particularly useful in actuation and deactuation of a horn device carried onboard a model railroad car where the horn actuation and deactuation occurs at specific selected locations on a track as the model train traverses the layout.

In accordance with the present invention it has been found that actuation and deactuation by magnetic fields is particularly appropriate in connection with a model railroad layout where the model railroad travels on a pair of tracks, usually of opposite electrical polarity, and where magnetic means having north and south relative poles can be used to both actuate and deactuate the horn mechanism regardless of the direction of travel of the model railroad train.

Moreover, it has been found that a horn can be provided which is small enough to be carried onboard yet provide satisfactory output sound and includes isolator means providing a square wave output signal of selected frequency where the output signal provides a signal supplied to a speaker means to generate a sound which simulates a diesel horn or a steam horn depending on the frequencies selected.

Moreover, it has been found that in connection with the subject invention a ramp voltage means can be provided in connection with the provision of a sound similar to that of a steam whistle to provide the intensity and frequency variation normally associated with a steam whistle.

BRIEF DESCRIPTION OF THE DRAWINGS

Referring now to the Figures which illustrate examples of arrangements within the scope of the present invention.

it is to be understood that the following disclosure with reference to the accompanying figures is by way of illustration only and that other arrangements within the scope of the present invention will occur to those skilled in the art upon reading the disclosure.

DESCRIPTION OF THE PREFERRED EMBODIMENT

Figure 1:
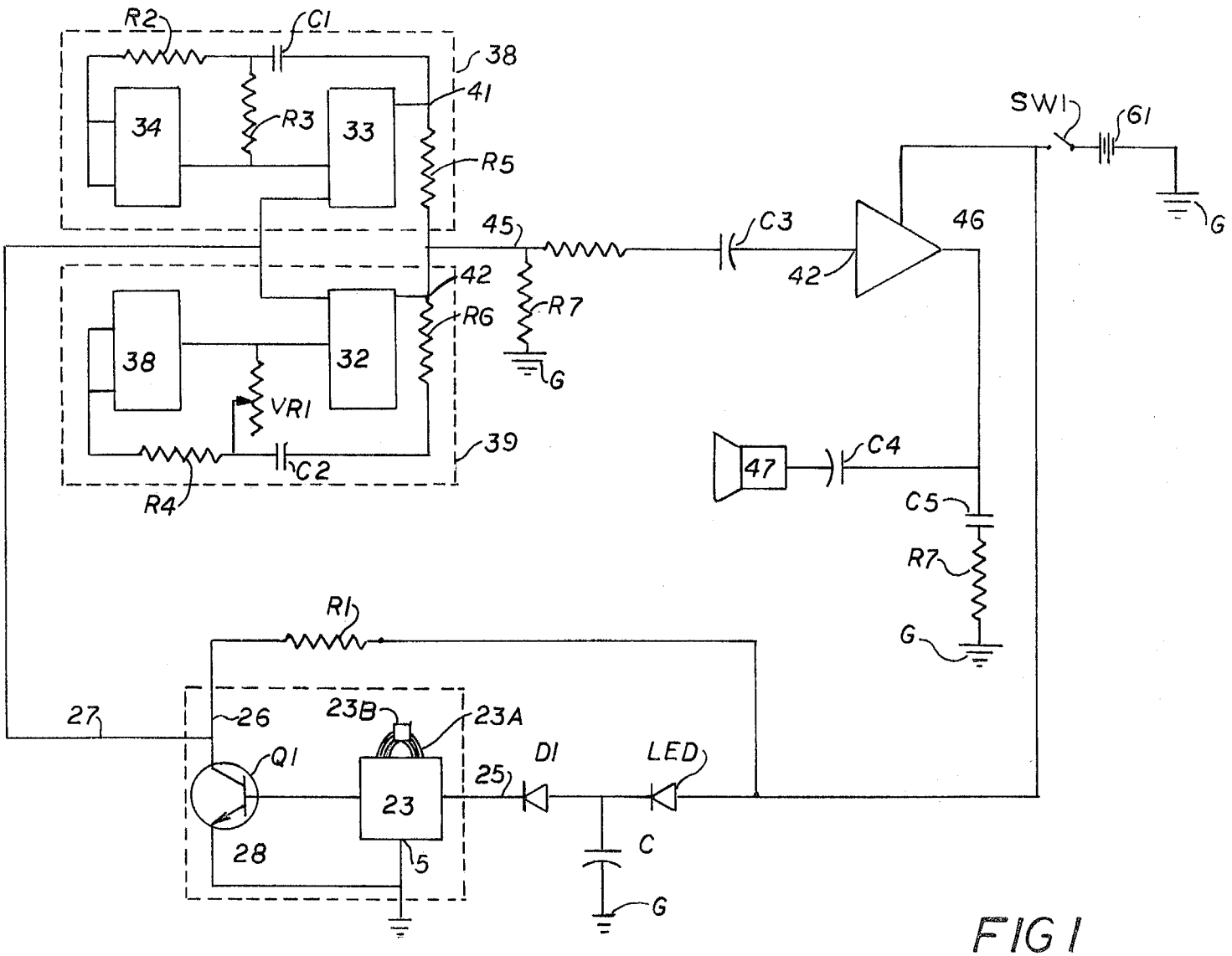
FIG. 1 is a schematic diagram of a circuit utilizing a dual frequency horn to be activated and deactivated as the device is passed through selected magnetic fields.
Figure 5:
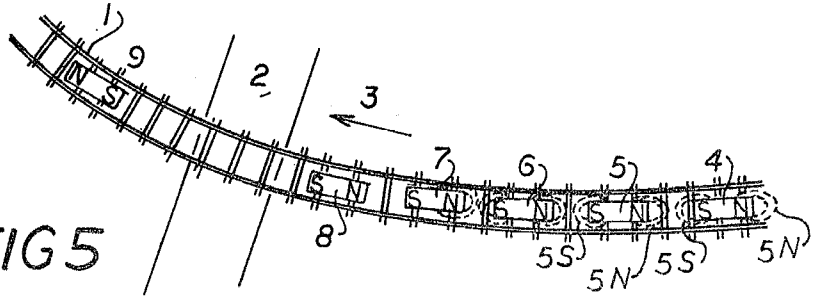
FIG. 5 is an illustration of one example of an arrangement of magnets on a model railroad track within the scope of the present invention.

Referring to FIG. 1 the Figure of a circuit within the scope of the present invention is illustrated which would be carried onboard a model train car (not shown) traveling on a track 1, illustrated in FIG. 5. In one application in model railroading it is desirable to blow a horn one or more times as the train approaches a crossing 2, then blow the horn as the train passes through the crossing.

To accomplish this, as described hereinafter, magnets 49 are located on the track to blow the horn twice before the crossing and through the crossing as the train travels in the direction by N for north pole and S for south pole.

Figure 2:
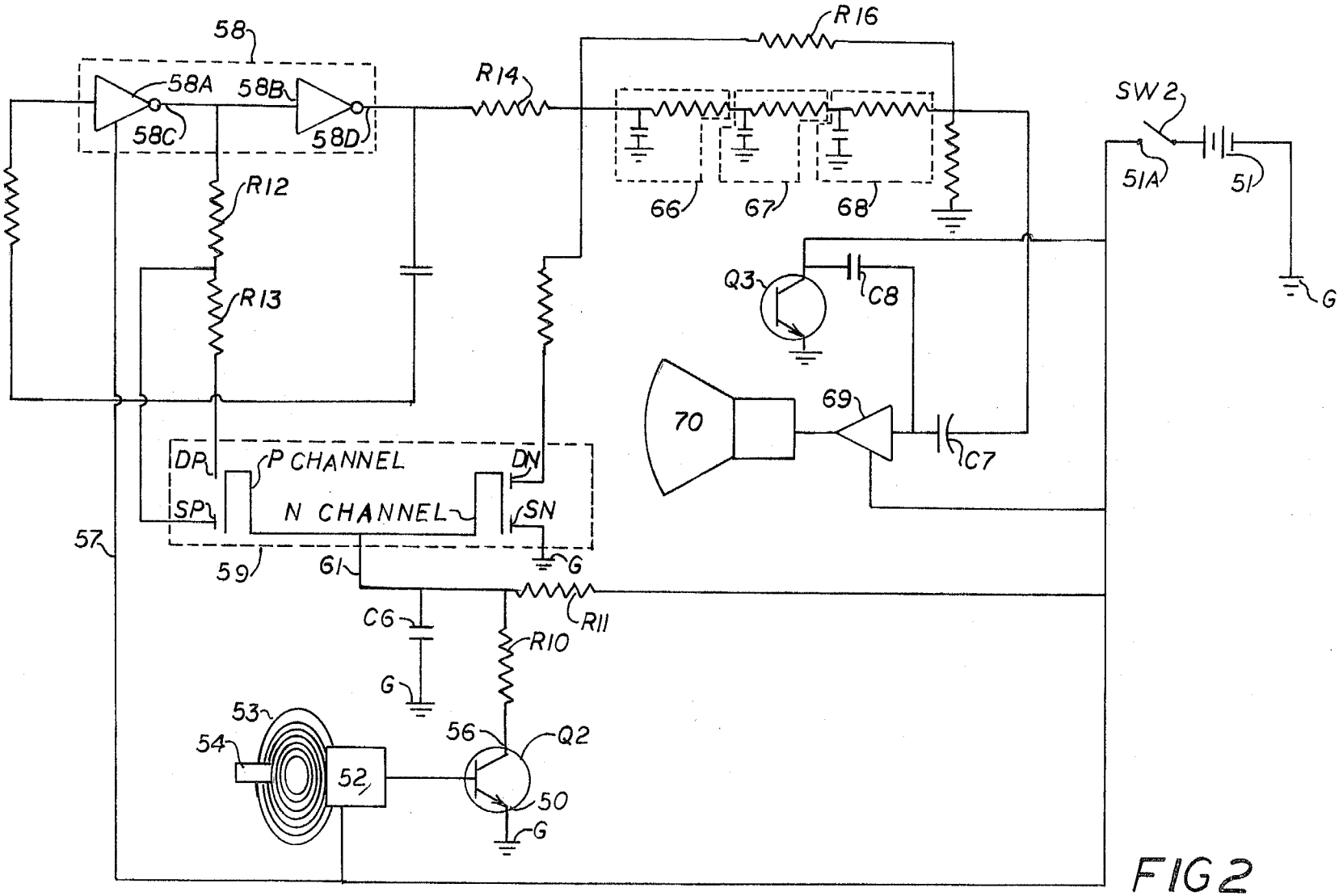
FIG. 2 is a schematic diagram of a circuit utilizing a horn device with selectively variable frequency and intensity which can be activated and deactivated as the device is passed through selected magnetic fields.

In the circuits illustrated in FIGS. 1 and 2 batteries 21 and 41 are provided to supply direct current source of power but it will be recognized that within the scope of the present invention direct current power could be utilized from track 1.

Again with reference to FIG. 1, battery 21 for example a 9 volt battery is shown, with its anode A connected through an off-on switch SWI to supply power to an audio amplifier 22 and, through a light emitting diode (LED) in series with a silicon diode to Vcc of a Hall effect integrated circuit 23 for example a Type TL170C manufactured by Texas Instruments, Inc. The two diodes in series provide a voltage drop of 2 Vdc to insure that Vcc does not exceed the maximum for 7.5 Vdc, and the LED provides an indication of battery condition.

As is known in the art the output of the Hall effect detector 23 is connected to the base of its internal NPN transistor Q1. Collector 26 of Q1 is connected to the source voltage A through a delay resistor R1 to maintain a positive voltage on lead 27 when transistor Q1 is in the nonconductive state. On initial application of battery voltage in the absence of any magnetic fields, the base of Q1 is at ground potential, so Q1 does not conduct, resulting in a positive voltage on lead 27. Emitter 28 of transistor Q1 and the ground connector 5 of Hall Effect tector 23 are converted in common to ground at G.

Figure 3:
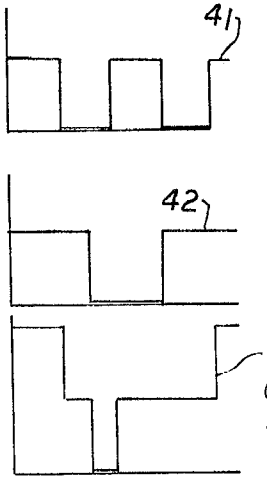
FIG. 3 is a diagram of a portion of the frequency spectrum of the horn of FIG. 1.

As shown, collector 26 is connected by lead 27 to the positive inputs 36, 37 of NOR gates 32, 33. Each NOR gate 32–33 as cooperatively associated with a second NOR Gate 31, 34 respectively to provide dual square wave oscillators circuits 38, 39 to provide square wave signals at outputs 41, 42. The square wave signals at output 41, 42 which are, advantageously of different frequency but combined to form a signal of composite frequency as shown in FIG. 3. As shown oscillator circuit 38 includes a feedback loop including resistors R2–R3 and capacitor C1 to generate the square wave signal.

Likewise oscillator circuit 39 includes a feedback loop including a capacitor C2, a resistor R4 and rheostat VR1 which provides output signal frequency selection. Outputs 41 and 42 are connected in common with resistors R5 and R6 to resistor R7 connected to ground G to set output volume and in series through coupling capacitor C3 to the input of an audio amplifier 44.

Output 46 from amplifier is connected through a coupling capacitor C4 to speaker 47 located on the model railroad car.

Output 46 is also connected through a snubber circuit including a capacitor C5 and resistor R7 to ground G to stabilize the amplifier.

FIG. 3, illustrates the signals provided by outputs 41 and 42 and the combined signal provided at input 42 to amplifier 44 which simulates the mixed frequency sound produced by the horn utilized in a diesel locomotive.

In operation the circuit shown in FIG. 1 is provided in a car traveling on track 1 in the direction shown by arrow 3 of FIG. 5.

As is known, Hall effect sensor 23 can be adapted to supply base current to transistor Q1 in the pressure of a selected south magnetic field 23A magnet 23B.

In the arrangement shown, the base current is supplied to input 25 of sensor 23 at approximately +7 vdc. The Hall effect sensor 23 is activated to supply base current to output 24 in the presence of a negative magnetic field or south polarity. The base current flows until a positive or north polarity is received at which time sensor 23 goes to low state and base current flow again terminates until sensor 23 is exposed to a field of negative polarity.

Thus referring to FIG. 5, as a car carrying the sensor 23 travels in the direction shown by arrow 3, sensor 23 would normally be in the low state but if in the high state would be driven to a low state by the field N4 of north pole of magnet 4 and is activated in passing through the field S4 created by the south pole so base current is supplied to transistor Q1 and the horn begins to blow.

The car next passes over magnet 5 where sensor 23 goes to a low state upon exposure to the positive or north magnetic field N5 of the magnet so operation of the horn is terminated. The horn is again actuated in passing over the south magnetic field S6 provided by the south pole of magnet 6 and so forth in passing over magnets 7, 8 and 9.

Figure 6:
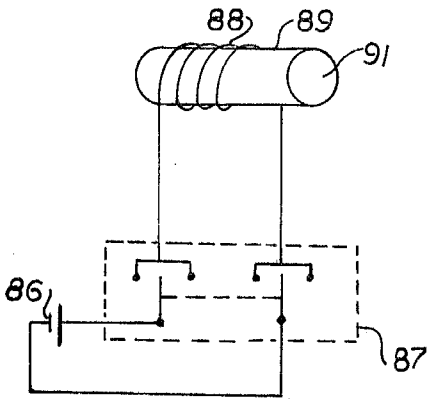
FIG. 6 is an illustration of an alternative magnet arrangement for use within the scope of the present invention.

The illustration of FIG. 5 is based on the use of permanent magnets where the actuation and deactuation of the horn is fixed. Within the scope of the present invention, electromagnetic sources as illustrated in FIG. 6 can be used. In such arrangements a magnetic core 89 can be provided where air end 94 is exposed to the Hall effect detector. The circuit includes a power source 86 and a switch 87 so the polarity of end 94 can be selected or can be of no polarity.

It will be noted that the relative periods of activation and deactivation are determined by the spacing between the magnets and that the horn can be actuated through crossing 2.

Referring now to FIG. 2 an arrangement is provided to produce a sound simulating a steam whistle. A source of dc voltage for example a battery 51 with its cathode grounded at G is provided to supply dc voltage through switch SW2 at anode 51A to a Hall Effect detector 52 which is selectively activated and deactivated, by magnetic field 53 of a magnet 54 to supply and terminate base current flow to transistor Q2 with grounded emitter 50 having its collector 56 connected by lead 57 to supply Vss to an oscillator 58 for example a gated CMOS square wave oscillator with dual inverters 58A and 58B as known in the art where the oscillator is off when lead 57 is high, and through a delay resistor R12 and R13 to annode 51A of battery 9 and through resistor R11 to the annode of capacitor C6 having its cathode grounded so that capacitor C6 is charged when transistor Q1 is off. The annode of capacitor C6 is connected to switch means 59 for example to gate 61 between the N and P channels of a CMOS transistor where the P channel is conductive through the drain DP and source SP when terminal 61 is high and where the N channel is conductive through drain DN and source SN when terminal 61 is low.

As shown oscillator 58 includes frequency control resistor R12 and R13 connected in series between output 58C of inverter 58A and drain DP of the P channel where source SP is connected to shunt out resistor R13.

Drain DN of channel N of switch 59 is connected through resistor R14 of lead 60 to the output of inverter 58B while source SN of channel N is connected to ground G so as gate 61 goes high channel N goes nonconductive.

Output 58D of oscillator 58 provides a square wave signal of first increasing then steady, then decaying frequency as described hereinafter. The output can be connected through a 3-section RC filter 66–68 to convert the signals to sine wave signal which is provided through coupling capacitor C7 to amplifier 69.

Also within the scope of the present invention a shunt circuit 71 including resistor R16 can be provided around circuits 66–68 to provide square wave harmonics to be combined and supplied to amplifier 69.

Additionally, when the circuit shown is utilized to produce a sound simulating a steam whistle, a white noise generator such as a transistor Q2 with its emitter grounded and collector connected through resistor R17 to annode 51A and through capacitor C8 to the input of amplifier 69. Of course transistor Q3 is operated above its breakdown voltage to provide a background signal through capacitor C8 the input.

Figure 4A:
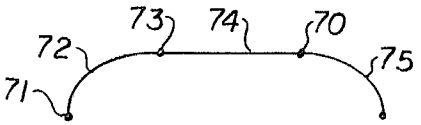
FIGS. 4*a* and 4*b* are diagrams of the intensity and frequency pattern of the horn of FIG. 2.
Figure 4B:
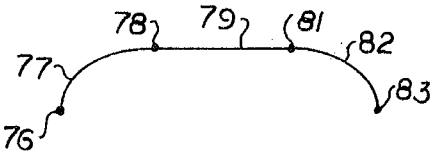

The combined signal is supplied through a coupling capacitor C7 and to an amplifier 69 and speaker 70 where it has been found that the foregoing arrangement unexpectedly provides an output sound bearing unexpectedly close resemblance to the sound of a railroad steam engine whistle as illustrated in FIGS. 4*a*-4*b*. In FIGS. 4*a* which is a diagramical representation of the output frequency, point 71 represents the point of initiation where Hall Effect detector 52 activates transistor Q2. At this point channel P of switch 59 is conductive because terminal 61 is high so that current is drained from output 58*c* of inverter 58 and provides a lower intensity signal. As current drains from terminal 61 through transistor Q1 the P channel goes conductive to shunt out resistor R13 and raise the frequency of the output of oscillator 58 from point 71 along line 72 to point 73. Finally the frequency is stabilized at a frequency represented by point 73 and continues along line 74 for so long as transistor Q1 is actuated. Upon deactuation of transistor Q1 the cycle is reversed and frequency drops off along line 75.

With respect to intensity, as illustrated in FIG. 4*b*, the N channel of switch 59 is conductive when terminal 61 is high so there is a current drain from the output so the oscillator output signal intensity is lowered in proportion to the drain through the N channel. As terminal 61 goes low, the drain through lead 60 diminishes so that the intensity of the output signal increases from the initial point 76 along line 77 to point 78 where the signal intensity is constant along line 79 so long as transistor Q1 is actuated. Upon deactuation of transistor Q1 at point 81 the N channel commences to go conductive, drain through lead 60 increases and the signal intensity diminishes along line 82.

While the example here is illustrated with respect to one oscillator device it will be understood that additional frequencies and oscillator devices can be utilized within the scope of the present invention.

As shown, the output from oscillator 58 is supplied to RC filter 66–68 to provide a modified sine wave signal to amplifier 69. Additionally, a shunt is provided through delay resistor R16 around RC filter 66–68 to supply delayed square wave harmonics signals to be mixed with the output from RC filter 68 where it has been unexpectedly found that the added square wave signal provides additional quality to the sound provided by said input signal.

The invention claimed is:

1. A horn and actuator circuit to provide selective actuation and deactuation of horn means including:

(a) horn means located on a vehicle adapted to travel on cooperative track means;

(b) power supply means to supply direct current electric power to said horn means;

(c) switch means carried by said vehicle to control supply of power from said power supply means to said horn means;

(d) magnetic field sensitive switch actuator means carried by said vehicle to actuate said switch means between first conductive state and second nonconductive state and including magnetic field sensing, means where said actuator means is sensitive to magnetic fields of first and second polarity to position said switch in said first state in response to magnetic field of said first polarity and to position said switch in said second position in response to magnetic field of said second polarity; and (e) at least two spaced magnetic field sources of different polarity positioned adjacent said tract means to relatively provide magnetic fields of said first and second polarity to said switch actuator means.

2. The invention of claim 1 wherein said horn means includes at least two oscillator means, each adapted to provide a square wave output signal of different frequency; mixing means to additively mix said output signals from said first and second oscillator means to provide additive square wave signals of varying intensity to the input of speaker means to provide sound reflection of said input signal.

3. The invention of claim 1 wherein said horn means includes oscillator means to provide square wave direct current output signal, wherein a first portion of said square wave output signal is supplied to cooperative capacitance resistance circuit means to provide rounded direct current signal and where a second portion of said square wave output signal is supplied resistor circuit means to provide time delayed signal means; adder means to combine said rounded direct current signal and said delayed square wave signal to the input of speaker means to provide selected sound pattern.

4. The invention of claim 3 including white noise signal generator means where the output of said white noise generator means is added to the input of said speaker means to provide background signal.

5. The invention of claim 3 including voltage control means operable by said actuator means to selectively increase the frequency and intensity of the square wave direct current signal output of said oscillator means at a selected rate of rise where said switch means first is placed in said first state and to provide maximum frequency and intensity of said square wave direct current signal.

6. The invention of claim 1 wherein the polarity of said magnetic field generating means can be selected.

7. The invention of claim 1 wherein said horn means includes steam whistle sound generating means including:

(a) at least one oscillator means to generate square wave output signal;

(b) direct current power supply means to supply direct current electrical power to said oscillator means;

(c) first switch means operable between first position to supply electrical power to said oscillator means and second position to terminate supply of electrical power to said oscillator means;

(d) second switch means operable by said first switch in said first position to selectively increase the frequency and intensity of said output signal at selected rate for a selected time period and to selectively decrease the intensity and frequency of said output signal for a selected time period in response to movement of said first switch to said second position.

8. The invention of claim 3 including resistance-capacitance filter means to modify said output signal to provide modified sine wave signal and speaker means to convert said modified sine wave signal to a corresponding audible signal.

9. The invention of claim 4 including resistance capacitance bypass means to mix a portion of said output signal with said modified sine wave signal.

10. The invention of claim 5 wherein said resistance capacitance bypass means includes resistor means to delay said output signal prior to mixing with said modified sine wave signal.

11. The invention of claim 4 including selected frequency signal supplied to said speaker means with said modified sine wave signal.

* * * * *